US008928236B1

(12) United States Patent
Mays, II et al.

(10) Patent No.: US 8,928,236 B1
(45) Date of Patent: Jan. 6, 2015

(54) LED DRIVER CIRCUIT WITH UNIFIED CONTROLLER

(71) Applicant: Universal Lighting Technologies, Inc., Madison, AL (US)

(72) Inventors: Stephen D. Mays, II, Madison, AL (US); John J. Dernovsek, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/031,485

(22) Filed: Sep. 19, 2013

Related U.S. Application Data

(60) Provisional application No. 61/702,867, filed on Sep. 19, 2012.

(51) Int. Cl.
*H05B 37/02* (2006.01)

(52) U.S. Cl.
CPC ..... *H05B 37/02* (2013.01)
USPC ..... 315/200 R; 315/291; 315/308

(58) Field of Classification Search
USPC ..... 315/200 R, 209 R, 276, 291, 307, 308
See application file for complete search history.

(56) References Cited

U.S. PATENT DOCUMENTS 5,925,990 A 7/1999 Crouse et al.
7,495,398 B2 * 2/2009 Sakamoto et al. ..... 315/292

* cited by examiner

*Primary Examiner* — Jimmy Vu
(74) *Attorney, Agent, or Firm* — Wadey Patterson; Mark J. Patterson; Mark A. Pitchford

(57) ABSTRACT

A constant current LED driver circuit includes a unified controller operable to control start up peripheral circuits and control power output of the driver circuit. The unified controller initializes, starts driver circuit components in a predetermined order, and controls operation to prevent runaway operation, failure to start, and nuisance shut downs. Additionally, due to centralized operational condition monitoring, the controller can detect conditions that would cause unnecessary shut downs and prevent such nuisance shutdowns. The unified controller enables fast, finite control over switches of a DC-to-DC converter of the driver circuit to improve output current and voltage control, improving closed loop responsiveness and operation of the DC-to-DC converter.

20 Claims, 4 Drawing Sheets

LED DRIVER CIRCUIT WITH UNIFIED CONTROLLER

CROSS-REFERENCES TO RELATED APPLICATIONS

This application claims priority to and hereby incorporates by reference in its entirety U.S. Provisional Patent Application Ser. No. 61/702,867 filed on Sep. 19, 2012 entitled "LED Driver Circuit".

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to direct current (DC) driver circuits. More particularly, this invention pertains to constant current DC driver circuits for light emitting diode (LED) light sources.

Light fixtures including a driver circuit packaged with LEDs are replacing incandescent and compact fluorescent light bulbs. However, LED light packages and fixtures need to be controlled for temperature, voltage, and current. These light fixtures may include housings in shapes other than standard incandescent bulb packages. An LED driver circuit is typically a constant current driver circuit that controls current by varying the duty cycle and/or the switching frequency of a DC-to-DC converter in the driver circuit. The DC-to-DC converter may be a flyback or buck converter. Switches in the DC-to-DC converter are controlled by a pulse width modulation (PWM) circuit to provide power from the DC-to-DC converter to the LEDs. Separately, a dimming circuit interprets variations in an input voltage to the light fixture, or a control signal to the dimming circuit, to provide a microprocessor in the driver circuit with a signal indicative of a dimming level. The microprocessor controls the PWM circuit to adjust operation of the DC-to-DC converter accordingly.

In operation, when the light fixture receives power, portions of the driver circuit (i.e., the PWM circuit, the microprocessor, the dimming circuit, safety circuits, etc.) initialize in an uncontrolled fashion. This can potentially lead to runaway operation, over-voltage conditions, over-current conditions, and a failure to start. Additionally, startup fault detection combined with controlled shutdowns and restarts are generally not possible without significant additional circuitry. Control of the PWM circuit by the microprocessor is granular and activation of, for example, safety circuits can cause the driver circuit to intermittently shut down entirely when no actual fault exists (e.g., when the light fixture is operating near a predetermined temperature limit).

BRIEF SUMMARY OF THE INVENTION

Aspects of the present invention provide a constant current LED driver circuit includes a unified controller operable to control start-up of peripheral circuits and control power output of the driver circuit. The unified controller initializes, starts driver circuit components in a predetermined order, and controls operation to prevent runaway operation, failure to start, and nuisance shut downs. Additionally, due to centralized operational condition monitoring, the controller can detect conditions that would cause unnecessary shut downs and prevent such nuisance shutdowns. The unified controller enables fast, finite control over switches of a DC-to-DC converter of the driver circuit to improve output current and voltage control, improving closed loop responsiveness and operation of the DC-to-DC converter.

In one aspect, a method of providing power from an alternating current (AC) power source to a light source via a driver circuit includes receiving power at a controller of the driver circuit from the AC power source via an AC to direct current (DC) converter. The controller initializes in response to receiving power from the AC-to-DC converter. After initializing, the controller enables power to pass from the AC-to-DC converter to a peripheral circuit. After enabling power from the AC-to-DC converter to the peripheral circuit, the controller provides a drive signal to a DC-to-DC converter of the driver circuit. Providing the drive signal includes ramping up a duty cycle of the drive signal to a duty cycle corresponding to a predetermined output current of the driver circuit. The DC-to-DC converter receives the drive signal and provides power from the AC-to-DC converter to the light source as a function of the received drive signal. The controller monitors a current of the light source, a voltage of the light source, and a voltage of a low-voltage output of the AC-to-DC converter. The controller adjusts the drive signal as a function of the monitored current to the light source, monitored voltage of the light source, and the monitored voltage of the low-voltage output of the AC-to-DC converter.

In another aspect, a driver circuit is operable to provide power from an AC power source to a light source. The driver circuit includes an AC-to-DC converter, a peripheral circuit, a DC-to-DC converter, and a controller. The AC-to-DC converter includes a low-voltage output, and the AC-to-DC converter receives power from the AC power source and provides power at the low-voltage output. The peripheral circuit receives power from the AC-to-DC converter. The DC-to-DC converter provides power from the AC-to-DC converter to the light source as a function of a drive signal. The controller initializes in response to receiving power from the low-voltage output of the AC-to-DC converter. The controller further enables power to the peripheral circuit from the AC-to-DC converter after initializing. After enabling power from the AC-to-DC converter to the peripheral circuit and waiting a predetermined period of time, the controller provides the drive signal to the DC-to-DC converter. Providing the drive signal to the DC-to-DC converter includes ramping up a duty cycle of the drive signal to a duty cycle corresponding to a predetermined output current. The controller monitors a current of the light source, voltage of the light source, and a voltage of the low-voltage output of the AC-to-DC converter. The controller further adjusts the drive signal as a function of the monitored current to the light source, the voltage of the light source, and a voltage of the low-voltage output of the AC-to-DC converter.

In another aspect, a light fixture operable to receive power from an AC power source and provide light includes a light source, a driver circuit, and a housing. The light source provides light in response to receiving power. The housing supports the light source and the driver circuit. The driver circuit includes an AC-to-DC converter, a peripheral circuit, a DC-to-DC converter, and a controller. The AC-to-DC converter includes a low-voltage output, and the AC-to-DC converter receives power from the AC power source and provides power at the low-voltage output. The peripheral circuit receives power from the AC-to-DC converter. The DC-to-DC converter provides power from the AC-to-DC converter to the light source as a function of a drive signal. The controller initializes in response to receiving power from the low-voltage output of the AC-to-DC converter. The controller further enables power to the peripheral circuit from the AC-to-DC converter after initializing. After enabling power from the AC-to-DC converter to the peripheral circuit and waiting a predetermined period of time, the controller provides the drive signal to the DC-to-DC converter. Providing the drive signal to the DC-to-DC converter includes ramping up a duty cycle of the drive signal to a duty cycle corresponding to a predetermined output current. The controller monitors a current of the light source, a voltage of the light source, and a voltage of the low-voltage output of the AC-to-DC converter. The controller further adjusts the drive signal as a function of the monitored current to the light source, the voltage of the light source, and a voltage of the low-voltage output of the AC-to-DC converter.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As used herein, "ballast" or "driver circuit" refers to any circuit for providing power (e.g., current) from a power source to a light source. Additionally, "light source" refers to one or more light emitting devices such as fluorescent lamps, high intensity discharge lamps, incandescent bulbs, and solid state light-emitting elements such as light emitting diodes (LEDs), organic light emitting diodes (OLEDs), and plasmaloids.

Figure 1:
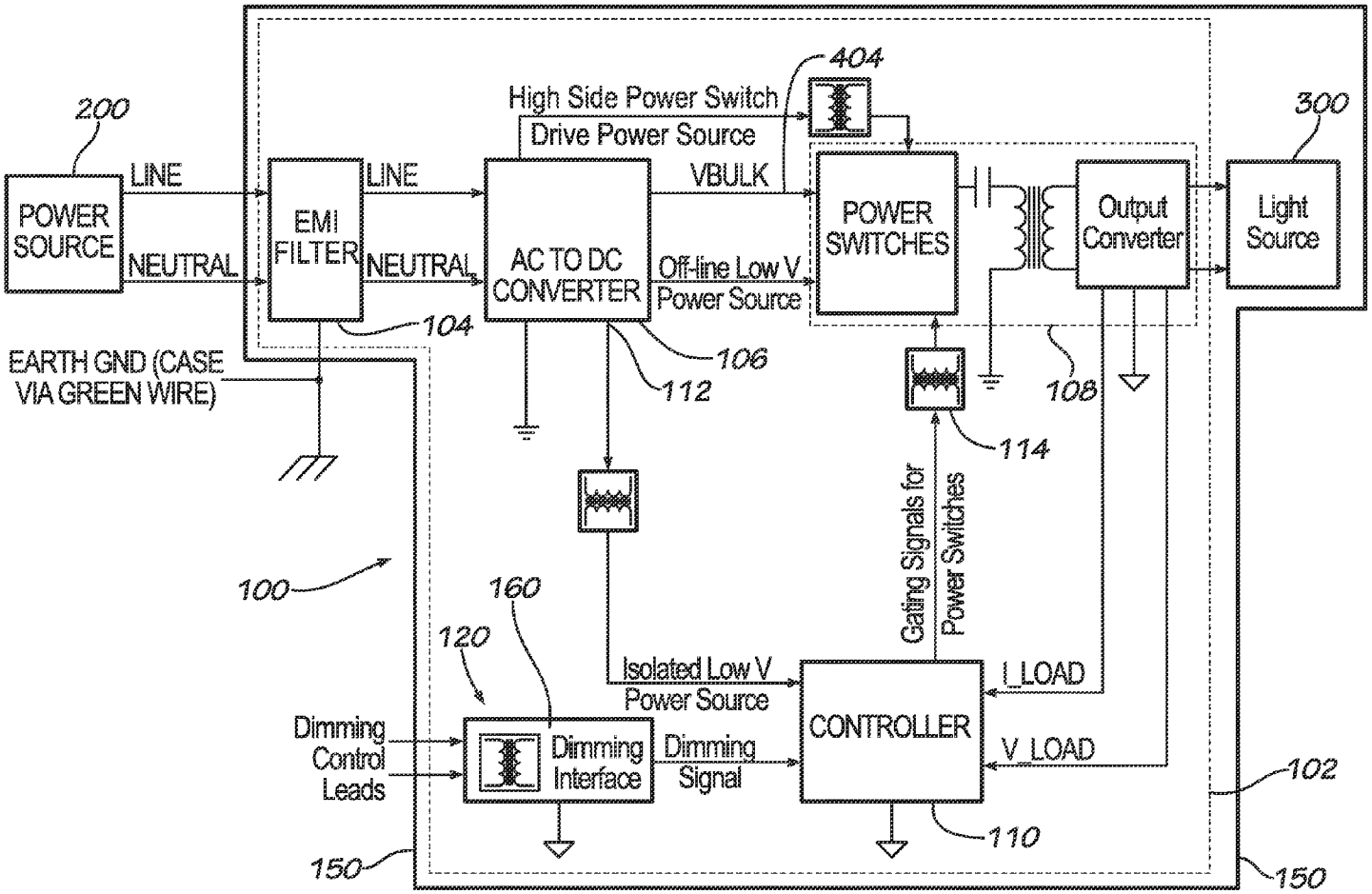
FIG. 1 is a block diagram of a light fixture.
Figure 2:
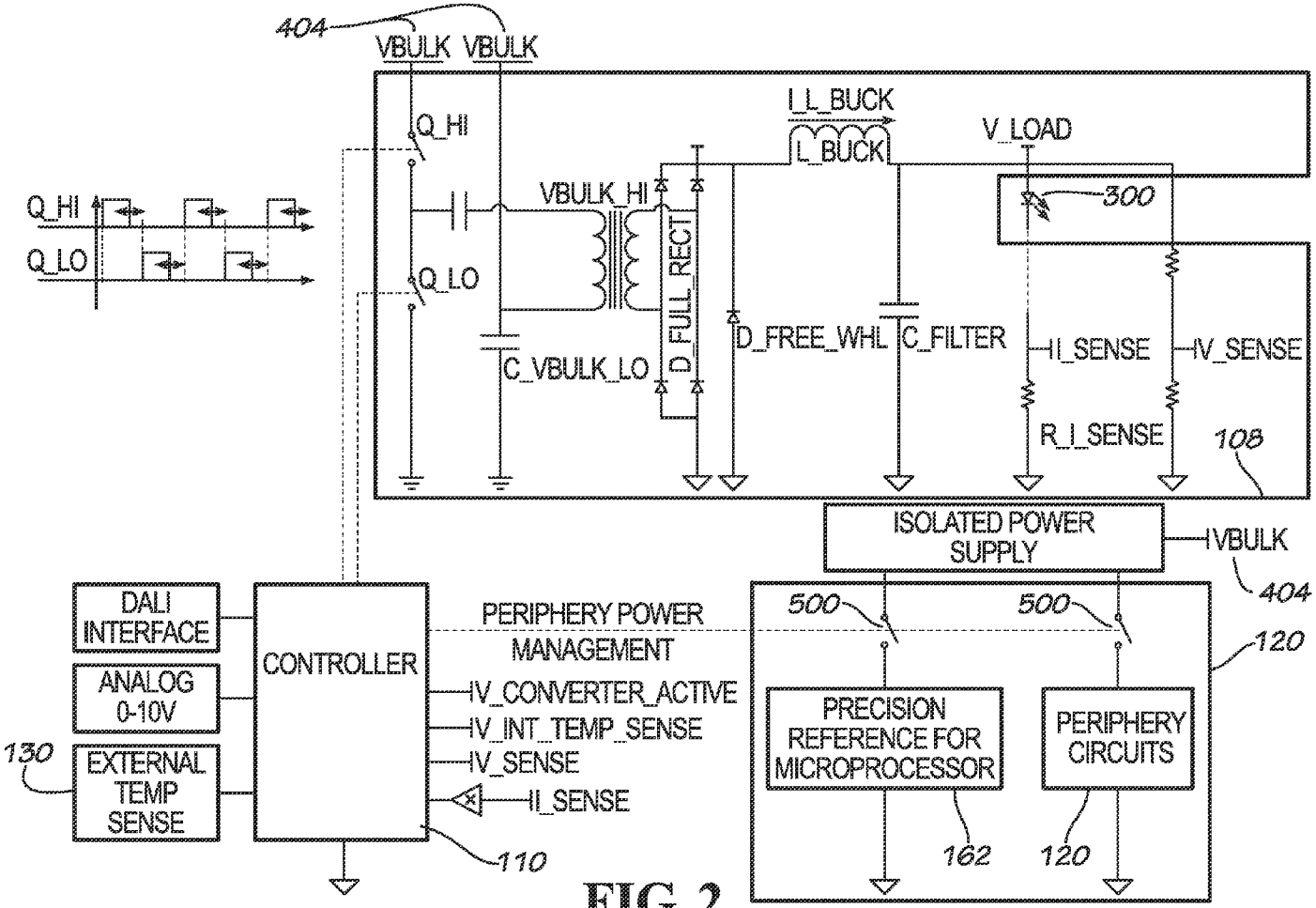
FIG. 2 is block diagram and partial schematic diagram of a driver circuit.

Referring to FIGS. 1 and 2, an LED driver circuit 102 includes an electromagnetic interference (EMI) filter 104 and an active power factor correction (PFC) input stage (i.e., AC-to-DC converter 106) with an isolated buck converter output stage (i.e., DC-to-DC converter 108). The entire output stage (i.e., DC-to-DC converter 108 and peripheral sensor circuits) is controlled and managed by a controller 110 that measures analog and pulsed signals from multiple sources and both develops appropriate power switch signals (i.e., drive signals) and manages its own power sources (e.g., reference power circuits).

When the PFC (AC-to-DC) converter 106 becomes active, the output control section of the PFC converter 106 becomes energized, activating the controller 110 by providing power to the controller 110 via a low voltage output 112 of the PFC converter 106. After the controller 110 initializes (i.e., stabilizes) itself, the controller 110 enables power to peripheral circuits 120. This will establish a stable and well-defined voltage reference for the controller's control loops. This will also make power available for the peripheral circuit 120 (e.g., dimming interface and circuitry to transfer input power switch signals such as gate drive isolation transformer 114).

In one embodiment, the light fixture 100 receives AC power from the AC power source 200 and provides illumination. In one embodiment, the AC power source 200 may be line power (e.g., 115 V at 60 Hz). The light fixture 100 includes a light source 300, the driver circuit 102, and a housing 150. The light source 300 provides illumination in response to receiving power from the driver circuit 102. In one embodiment, the light source 300 includes a string of series connected LEDs. The housing 150 supports the driver circuit 102 and the light source 300. The housing 150 may be compact as in the case where the light fixture 100 is an incandescent bulb replacement. Optionally, the housing 150 may include additional components such as light diffusers and decorative surroundings.

The driver circuit 102 provides power from the AC power source 200 to the light source 300. The driver circuit 102 includes the PFC (AC-to-DC) converter 106, a peripheral circuit 120, and a DC-to-DC converter 108. The AC-to-DC converter 106 includes a low voltage output 112. The AC-to-DC converter 106 receives power from the AC power source 200 and provides power at the low voltage output 112. In one embodiment, the AC-to-DC converter provides active power factor correction. The AC-to-DC converter 106 also includes a high voltage DC output 404 (Vbulk). The high voltage DC output 404 provides power to the DC-to-DC converter 108.

The peripheral circuit 120 receives power from the AC-to-DC converter 106. Depending on the configuration of the peripheral circuit 120, the peripheral circuit 120 may provide various sensor inputs or reference voltages to the controller 110. In one embodiment, the peripheral circuit 120 includes a gate drive circuit 114, a reference circuit 162, a dimming interface 160, signal amplifiers, and buffers. The reference circuit 162 (i.e., reference voltage generator) receives power from the AC-to-DC converter 106 and provides a reference voltage to the controller 110. The gate drive circuit 114 receives the drive signal from the controller 114, isolates the drive signal via a gate drive isolation transformer, and provides the isolated drive signal to the DC-to-DC converter 108. In one embodiment, the DC-to-DC converter 108 may be a transformer 402 and is configured as an isolated DC-to-DC converter 108 such that the output of the driver circuit 102 is fully isolated from the input of the driver circuit 102 (i.e., from the power source 200). The DC-to-DC converter 108 provides power from the AC-to-DC converter 106 to the light source 300 as a function of a drive signal provided by the controller 110.

In operation, the controller 110 initializes in response to receiving power from the low voltage output 112 of the AC-to-DC converter 106. The controller 110 enables power to components of the peripheral circuit 120 from the AC-to-DC converter 106 in a predetermined order after initializing. In one embodiment, the controller 110 enables and disables power from the AC-to-DC converter 106 to the peripheral circuit 120 by controlling one or more switches 500. A predetermined period of time after enabling power to the peripheral circuit 120, the controller 110 provides the drive signal to the DC-to-DC converter 108. Providing the drive signal to the DC-to-DC converter 108 includes ramping up a duty cycle of the drive signal to a duty cycle corresponding to a predetermined nominal output current. This predetermined output current corresponds to a default brightness level (e.g., full brightness). The controller 110 monitors a current of the light source 300, a voltage of the light source 300, and a voltage of the low voltage output 112 of the AC-to-DC converter 106. The controller 110 adjusts the drive signal as a function of the monitored current of the light source 300, the voltage of the light source 300, and the voltage of the low voltage output 112 of the AC-to-DC converter 106. The controller 110 thus reduces the duty cycle of the drive signal such that the voltage does not exceed a predetermined maximum light source voltage and the current does not exceed a predetermined maximum light source current. When the voltage of the low voltage output 112 of the AC-to-DC converter 106 falls below a predetermined minimum voltage, the controller 110 determines that power to the light fixture 100 has been shut off and reduces the duty cycle of the drive signal to zero. The controller 110 also disables power from the AC-to-DC converter 106 to components in the peripheral circuit 120 in a predetermined order.

In one embodiment, the controller 110 further monitors temperature of the driver circuit 102 via a temperature sensor 130 in the driver circuit 102. The temperature sensor 130 provides a temperature signal indicative of a sensed temperature of the driver circuit 102 to the controller 102. The controller 110 adjusts the drive signal by reducing the duty cycle of the drive signal as a function of the monitored temperature, reducing the duty cycle as a function of the voltage of the light source 300, and reducing the duty cycle of the drive signal as a function of the current of the light source 300.

Figure 3:
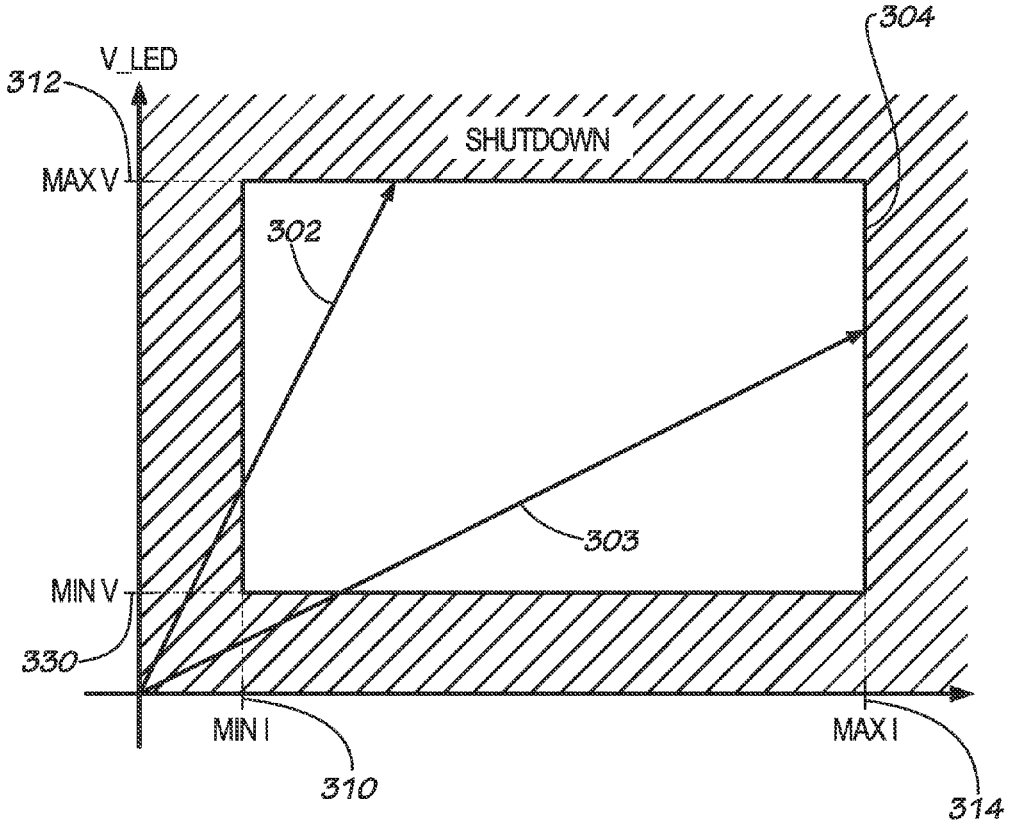
FIG. 3 is a graph of light source voltage versus current during nominal operation.

Referring to FIG. 3, during normal operation, as the controller 110 increases the duty cycle of the drive signal, the voltage and current of the light source 300 stay between a normal maximum nominal impedance 302 and a normal minimum impedance 303 as the controller 110 ramps up the duty cycle of the drive signal during startup. Following startup, the controller 110 maintains the voltage and current of the light source 300 within a voltage and current box defined by a minimum operating voltage 330, a maximum operating voltage 312, a minimum operating current 310, and a maximum operating current 314. The controller 110 varies the duty cycle and, under certain conditions, the frequency of the drive signal to maintain driver circuit output within the minimum and maximum voltage and current.

Figure 4:
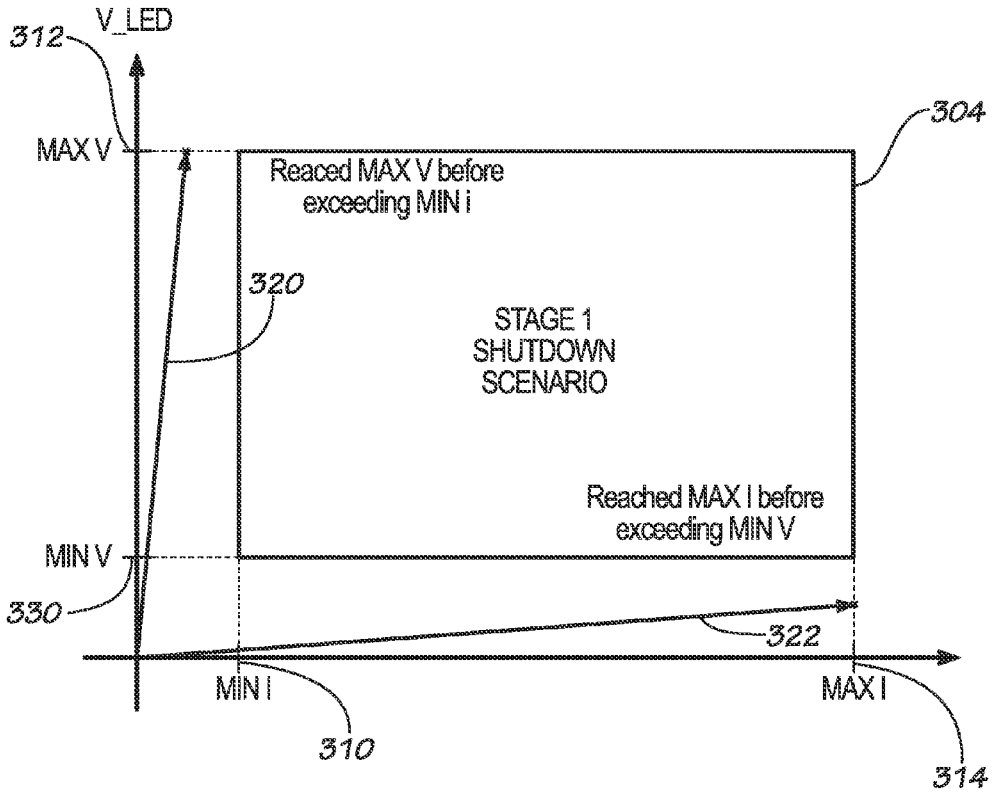
FIG. 4 is a graph of light source voltage versus current during abnormal startup operation.

Referring to FIG. 4, when a failure condition representing an open circuit light source 300 is present, the voltage of the light source increases to the maximum operational voltage 312 before the current reaches the minimum operational current 310 as shown by open circuit impedance line 320. When a failure condition representing a shorted light source 300 is present, the current of the light source 300 increases to the maximum operational current 314 before the voltage of the light source 300 reaches the minimum operating voltage 330 as shown by short circuit impedance line 322. In either the open circuit light source condition or the short circuit light source condition, the controller 110 reduces the duty cycle of the drive signal to zero and periodically attempts to restart operation (i.e., ramp up the duty cycle of the light source from zero to the default duty cycle).

Referring again to FIGS. 1 and 2, in one embodiment, the peripheral circuit 120 includes a dimming circuit or dimming interface. The dimming interface 160 receives a dimming input and provides a dimming signal to the controller 110 indicative of the received dimming input. The controller 110 adjusts the drive signal by setting the duty cycle of the drive signal as a function of the dimming signal and the current of the light source. The duty cycle is initially set to a duty cycle corresponding to a predetermined current of the light source indicated by the dimming signal, and the duty cycle is adjusted by the controller 110 to achieve the current corresponding to the desired current. The current is generally proportional to the brightness or dimming level of light output by the light source 300.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, may be configured to include at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful LED DRIVER CIRCUIT WITH UNIFIED CONTROLLER it is not intended that such references be construed as limitations upon the scope of this invention except as set forth in the following claims.

What is claimed is:

1. A method of providing power from an alternating current (AC) power source to a light source via a driver circuit, said method comprising:

receiving power at a controller of the driver circuit from the AC power source via an AC to direct current (DC) converter;

initializing the controller in response to receiving power from the AC-to-DC converter;

after initializing the controller, enabling power, via the controller, from the AC-to-DC converter to a peripheral circuit;

after enabling power from the AC-to-DC converter to the peripheral circuit, providing a drive signal from the controller to a DC-to-DC converter of the driver circuit, wherein said providing comprises ramping up a duty cycle of the drive signal to a duty cycle corresponding to a predetermined output current, and the DC-to-DC converter is operable to receive the drive signal and provide power from the AC-to-DC converter to the light source as a function of the received drive signal;

monitoring, via the controller, a current of the light source, a voltage of the light source, and a voltage of a low voltage output of the AC-to-DC converter; and adjusting the drive signal as a function of the monitored current of the light source, the voltage of the light source, and the voltage of the low voltage output of the AC-to-DC converter.

2. The method of claim 1, further comprising monitoring a temperature of the driver circuit via the controller, wherein:

adjusting the drive signal comprises reducing the duty cycle of the drive signal as a function of the monitored temperature;

adjusting the drive signal comprises reducing the duty cycle of the drive signal as a function of the voltage of the light source such that the voltage of the light source does not exceed a predetermined maximum operational light source voltage; and adjusting the drive signal comprises reducing the duty cycle of the drive signal as a function of the current of the light source such that the current of the light source does not exceed a predetermined maximum operational light source current.

3. The method of claim 1, wherein adjusting the drive signal comprises:

reducing the duty cycle of the drive signal to zero when the current of the light source reaches a predetermined maximum operational light source current before the voltage of the light source reaches a minimum operational light source voltage; and reducing the duty cycle of the drive signal to zero when the voltage of the light source reaches a predetermined maximum operational light source voltage before the current of the light source reaches a minimum operational light source current.

4. The method of claim 1, wherein:

the peripheral circuit comprises a dimming interface operable to receive a dimming input and provide a dimming signal to the controller indicative of the received dimming input; and adjusting the drive signal further comprises setting the duty cycle of the drive signal as a function of the dimming signal and the current of the light source, wherein the duty cycle is initially set to a duty cycle corresponding to a predetermined current of the light source indicated by the dimming signal.

5. The method of claim 1, wherein:

the DC-to-DC converter is an isolated DC-to-DC converter;

the AC-to-DC converter comprises a high voltage DC output, wherein the DC-to-DC converter is operable to receive power from the AC-to-DC converter via the high voltage output; and the drive signal is provided to the DC-to-DC converter from the controller via an isolation transformer.

6. The method of claim 1, wherein:

the peripheral circuit comprises a gate drive circuit operable to provide the drive signal from the controller to the DC-to-DC converter; and the peripheral circuit further comprises a reference circuit operable to provide a reference voltage to the controller.

7. The method of claim 1, wherein:

the AC-to-DC converter is operable to provide active power factor correction; and receiving power at the controller from the AC-to-DC converter comprises receiving power from the low voltage output of the AC-to-DC converter.

8. A driver circuit operable to provide power from an alternating current (AC) power source to a light source, said driver circuit comprising:

an AC to direct current (DC) converter comprising a low voltage output, wherein the AC-to-DC converter is operable to receive power from the AC power source and provide power at the low voltage output;

a peripheral circuit operable to receive power from the AC-to-DC converter;

a DC-to-DC converter operable to provide power from the AC-to-DC converter to the light source as a function of a drive signal;

a controller configured to initialize in response to receiving power from the low voltage output of the AC-to-DC converter, enable power to the peripheral circuit from the AC-to-DC converter after initializing, after enabling power from the AC-to-DC converter to the peripheral circuit, provide the drive signal to the DC-to-DC converter, wherein providing the drive signal comprises ramping up a duty cycle of the drive signal to a duty cycle corresponding to a predetermined output current, monitor a current of the light source, a voltage of the light source, and a voltage of the low voltage output of the AC-to-DC converter, and adjust the drive signal as a function of the monitored current of the light source, the voltage of the light source, and the voltage of the low voltage output of the AC-to-DC converter.

9. The driver circuit of claim 8, further comprising a sensor functional to sense a temperature of the driver circuit and provide a temperature signal to the controller, wherein the temperature signal is indicative of the sensed temperature, wherein the controller is further configured to adjust the drive signal by:

reducing the duty cycle of the drive signal as a function of the monitored temperature;

reducing the duty cycle of the drive signal as a function of the voltage of the light source such that the voltage of the light source does not exceed a predetermined maximum operational light source voltage; and reducing the duty cycle of the drive signal as a function of the current of the light source such that the current of the light source does not exceed a predetermined maximum operational light source current.

10. The driver circuit of claim 8, wherein the controller is configured to adjust the drive signal by:

reducing the duty cycle of the drive signal to zero when the current of the light source reaches a predetermined maximum operational light source current before the voltage of the light source reaches a minimum operational light source voltage; and reducing the duty cycle of the drive signal to zero when the voltage of the light source reaches a predetermined maximum operational light source voltage before the current of the light source reaches a minimum operational light source current.

11. The driver circuit of claim 8, wherein:

the peripheral circuit comprises a dimming interface operable to receive a dimming input and provide a dimming signal to the controller indicative of the received dimming input; and the controller is configured to adjust the drive signal by setting the duty cycle of the drive signal as a function of the dimming signal and the current of the light source, wherein the duty cycle is initially set to a duty cycle corresponding to a predetermined current of the light source indicated by the dimming signal.

12. The driver circuit of claim 8, wherein:

the DC-to-DC converter is an isolated DC-to-DC converter comprising a transformer;

the AC-to-DC converter comprises a high voltage DC output, wherein the DC-to-DC converter is operable to receive power from the AC-to-DC converter via the high voltage output; and the driver circuit further comprises an isolation transformer operable to provide the drive signal from the controller to the DC-to-DC converter.

13. The driver circuit of claim 8, wherein:

the peripheral circuit comprises a gate drive circuit operable to provide the drive signal from the controller to the DC-to-DC converter; and the peripheral circuit comprises a reference circuit operable to provide a reference voltage to the controller.

14. The driver circuit of claim 8, wherein the AC-to-DC converter is operable to provide active power factor correction.

15. A light fixture effective to receive alternating current (AC) power from an AC power source and provide light, said light fixture comprising:

a light source operable to provide light in response to receiving power;

a driver circuit operable to provide power from an alternating current (AC) power source to the light source, said driver circuit comprising an AC to direct current (DC) converter comprising a low voltage output, wherein the AC-to-DC converter is operable to receive power from the AC power source and provide power at the low voltage output, a peripheral circuit operable to receive power from the AC-to-DC converter, a DC-to-DC converter operable to provide power from the AC-to-DC converter to the light source as a function of a drive signal, a controller configured to initialize in response to receiving power from the low voltage output of the AC-to-DC converter, enable power to the peripheral circuit from the AC-to-DC converter after initializing, after enabling power from the AC-to-DC converter to the peripheral circuit, provide the drive signal to the DC-to-DC converter, wherein providing the drive signal comprises ramping up a duty cycle of the drive signal to a duty cycle corresponding to a predetermined output current, monitor a current of the light source, a voltage of the light source, and a voltage of the low voltage output of the AC-to-DC converter, and adjust the drive signal as a function of the monitored current of the light source, the voltage of the light source, and the voltage of the low voltage output of the AC-to-DC converter; and a housing configured to support the driver circuit and the light source.

16. The light fixture of claim 15, further comprising a sensor operable to sense a temperature of the driver circuit and provide a temperature signal to the controller, wherein the temperature signal is indicative of the sensed temperature, wherein the controller is configured to adjust the drive signal by:

reducing the duty cycle of the drive signal as a function of the monitored temperature;

reducing the duty cycle of the drive signal as a function of the voltage of the light source such that the voltage of the light source does not exceed a predetermined maximum operational light source voltage; and reducing the duty cycle of the drive signal as a function of the current of the light source such that the current of the light source does not exceed a predetermined maximum operational light source current.

17. The light fixture of claim 15, wherein the controller is configured to adjust the drive signal by:

reducing the duty cycle of the drive signal to zero when the current of the light source reaches a predetermined maximum operational light source current before the voltage of the light source reaches a minimum operational light source voltage; and reducing the duty cycle of the drive signal to zero when the voltage of the light source reaches a predetermined maximum operational light source voltage before the current of the light source reaches a minimum operational light source current.

18. The light fixture of claim 15, wherein:

the peripheral circuit comprises a dimming interface operable to receive a dimming input and provide a dimming signal to the controller indicative of the received dimming input; and the controller is configured to adjust the drive signal by setting the duty cycle of the drive signal as a function of the dimming signal and the current of the light source, wherein the duty cycle is initially set to a duty cycle corresponding to a predetermined current of the light source indicated by the dimming signal.

19. The light fixture of claim 15, wherein:

the DC-to-DC converter is an isolated DC-to-DC converter comprising a transformer;

the AC-to-DC converter comprises a high voltage DC output, wherein the DC-to-DC converter is operable to receive power from the AC-to-DC converter via the high voltage output; and the driver circuit further comprises an isolation transformer operable to provide the drive signal from the controller to the DC-to-DC converter.

20. The light fixture of claim 15, wherein:

the peripheral circuit comprises a gate drive circuit operable to provide the drive signal from the controller to the DC-to-DC converter;

the peripheral circuit comprises a reference circuit operable to provide a reference voltage to the controller;

the AC-to-DC converter is operable to provide active power factor correction.

* * * * *